United States Patent [19]

Harvey

[11] Patent Number: 4,711,288

[45] Date of Patent: Dec. 8, 1987

[54] HALIDE TREATMENT FOR ALUMINUM LOST FOAM CASTING PROCESS

[75] Inventor: Douglas J. Harvey, Sterling Heights, Mich.

[73] Assignee: General Motors Corporation, Detroit, Mich.

[21] Appl. No.: 10,239

[22] Filed: Feb. 2, 1987

[51] Int. Cl.[4] ..... B22C 9/04; B22D 27/00

[52] U.S. Cl. ..... 164/34; 164/45; 164/55.1

[58] Field of Search ..... 164/34, 35, 45, 246, 164/55.1, 56.1

[56] References Cited

U.S. PATENT DOCUMENTS 4,281,705 8/1981 Jeney ..... 164/34 X

*Primary Examiner*—Kuang Y. Lin

*Attorney, Agent, or Firm*—Douglas D. Fekete

[57] ABSTRACT

Casting aluminum by a lost foam process is improved by treating the metal during pattern replacement with a halide salt flux to inhibit formation of oxide fold defects. A preferred flux comprises a mixture of alkaline metal chloride compounds and includes an aluminum fluoride salt, such as sodium aluminum fluoride. In a preferred embodiment, the flux is incorporated into a polystyrene pattern prior to embedding the pattern in a sand mold and becomes dispersed on a front of the cast metal as the front progressively decomposes the pattern.

3 Claims, 1 Drawing Figure

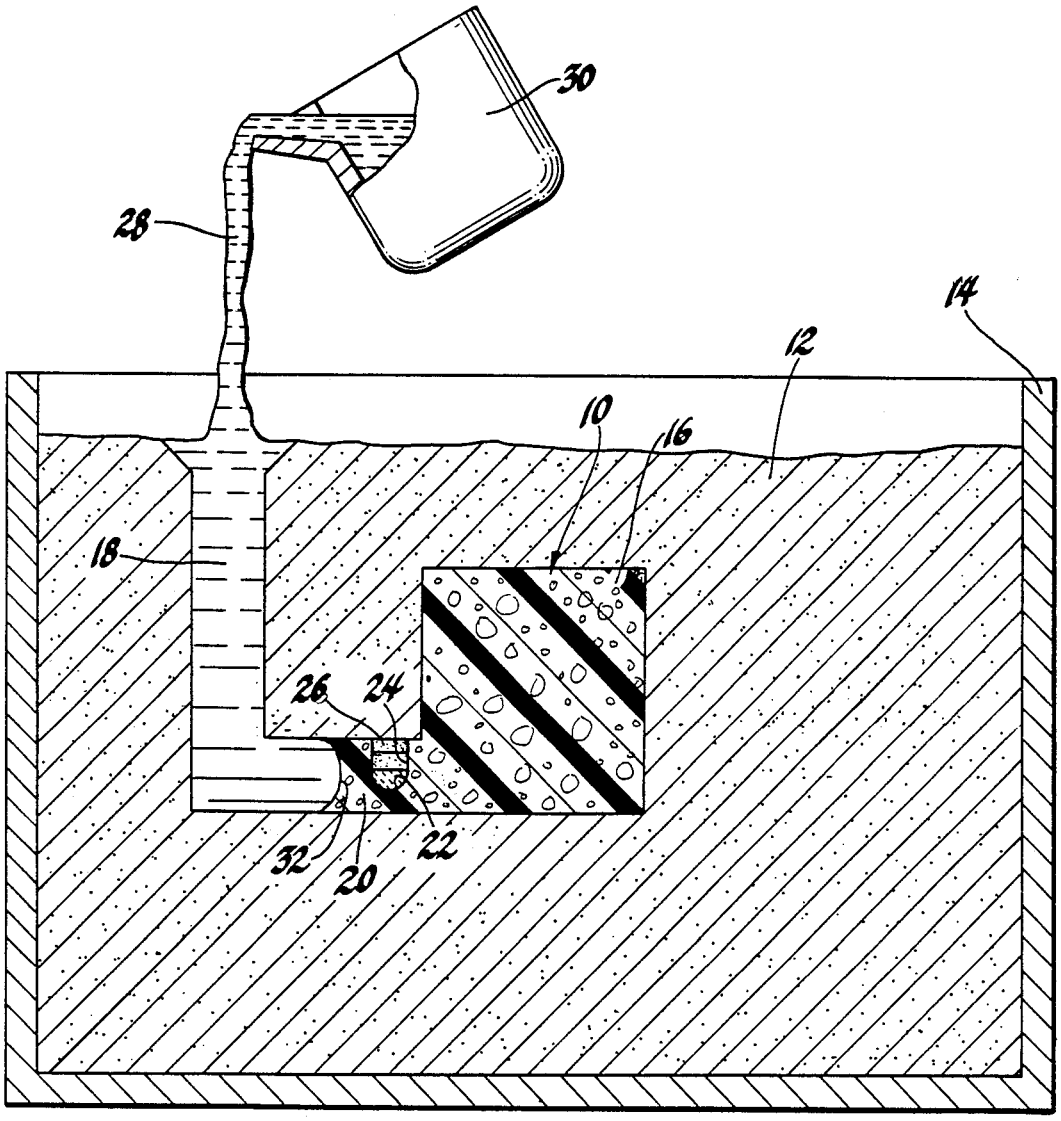
30
28
14
12
10
16
18
26
24
32
20
22

HALIDE TREATMENT FOR ALUMINUM LOST FOAM CASTING PROCESS

BACKGROUND OF THE INVENTION

This invention relates to a lost foam process for casting aluminum that comprises an in-mold treatment with a halide salt flux to inhibit formation of oxide fold defects in the cast product. More particularly, this invention relates to an aluminum lost foam casting process that incorporates a body of the halide flux into an expendable pattern for distribution onto a front of the cast metal as the front progressively decomposes the pattern during casting.

In a typical lost foam casting process, a vaporizable pattern formed of steam-fused polystyrene beads is embedded in a mold of unbonded refractory particles. Molten metal poured into the mold progressively decomposes and replaces the pattern.

It has been found that aluminum castings produced by a lost foam process may have a defect characterized by a thin aluminum oxide film within the body of cast metal. Although microscopically thin, the film may extend over an area as great as several hundred square millimeters. Based upon its appearance, it is postulated that the defect may be formed by a contaminated metal surface that becomes folded into the body of metal during casting, perhaps as the result of collapse of a melt front exposed to the decomposing pattern and oxidized by residual water therein. The fold typically contains carbon from the decomposing pattern, which has a noticeable black appearance. However, the problems associated with folds are mainly attributed to the tenacious oxide. The fold forms a sheet-like discontinuity in the body of metal, similar to particulate inclusions but having considerably greater area. This may substantially weaken a cross-section of the casting and lead to catastrophic fracturing. Also, fissures that form at the fold may produce a leak that may render the casting unsuitable for an intended hermetic use.

Oxide folds are extremely difficult to detect except after fracturing, since the film is mainly buried within the casting and forms at most only a microscopic line at the surface. Comparable defects are not reported for castings formed within a cavity, such as die castings. However, elimination of oxide fold defects has been a major concern in lost foam casting.

Therefore, it is an object of this invention to provide a treatment to improve soundness of an aluminum casting formed by a lost foam process, which treatment comprises suitably dispersing onto a metal surface adjacent the decomposing pattern within the mold a halide agent effective to inhibit formation of a tenacious oxide film on such surfaces and thereby decrease oxide fold defects in the product.

SUMMARY OF THE INVENTION

In accordance with a preferred embodiment of this invention, a polystyrene pattern for an aluminum lost foam casting comprises a body of a halide salt flux. A preferred flux is composed predominantly of a sodium and potassium chloride and contains an aluminum fluoride salt, such as cryolite. The flux is formulated to have a melting point less than aluminum casting temperatures. The flux is loaded into a compartment in the polystyrene pattern along the anticipated flow path of the cast metal upstream from a region susceptible to oxide fold formation. The pattern with the flux is embedded into an unbonded sand mold. Aluminum melt cast into the mold forms a front that progressively decomposes and replaces the polystyrene. As the front decomposes the pattern about the compartment, the flux is released and becomes dispersed onto the front. It has been found that this dispersion of the halide salt flux onto the melt front in accordance with this invention substantially reduces defects due to oxide folds in the product casting.

DESCRIPTION OF THE DRAWING

The only FIGURE is a cross-sectional view of a foundry apparatus showing a lost foam casting operation carried out utilizing a pattern comprising a flux body in accordance with this invention.

DETAILED DESCRIPTION OF THE INVENTION

Referring to the FIGURE, in a preferred embodiment of this invention, a halide salt flux is employed to treat aluminum-base metal cast by a lost foam process to duplicate a polystyrene pattern 10 embedded in a mold 12 formed of unbonded sand particles and contained within a suitable foundry vessel 14. Pattern 10, which is shown partially decomposed during a casting operation, comprises a downsprue portion shown replaced by metal at 18, a product portion 16, and a runner portion 20 connecting downsprue 18 to product portion 16. For purposes of this description, product portion 16 is adequately depicted as a simple shape, although it may be suitably sized and shaped to cast a desired product of more complex design. Pattern 10 is composed of a low density polystyrene foam material that vaporizes substantially without residue at aluminum casting temperatures. The polystyrene material is formed by fusing pre-expanded beads using steam. A thin, porous refractory coating (not shown), similar to a core wash, is applied to outer surfaces of pattern 10 to improve casting surface finish and provide thermal insulation during casting to prevent premature metal solidification.

In accordance with this invention, pattern 10 further comprises a body 22 of a halide salt flux for treating the metal during casting. Prior to embedding pattern 10 in mold 12, a compartment is formed preferably in runner portion 20 of pattern 10, into which is placed flux 22. A preferred flux is prepared by blending, by weight, 40 parts sodium chloride (NaCl), 40 parts potassium chloride (KCl) and 20 parts cryolite (sodium aluminum fluoride, $Na_3AlF_6$). The blend is fused to produce a more uniform composition and pulverized to a powder sized between 30 and 40 mesh. After loading the powder into compartment 24, the compartment is sealed by a polystyrene plug 26.

Pattern 10 containing flux 22 is suitably embedded in the sand mold 12, which sand is packed about the pattern, for example, by vibrating flask 14. The pattern is situated such that the downsprue communicates with the mold surface for admitting metal into the mold. Molten aluminum-base alloy 28 is poured from ladle 30 into downsprue 18. Upon contact with pattern 10, heat from the melt decomposes the polystyrene, whereupon the melt flows into the resulting void. In this manner, the melt progressively decomposes and replaces pattern 10. The progressive flow produces a front 32 immediately adjacent the decomposing pattern. When front 32 reaches flux 22, the flux particles, which are not soluble in the aluminum melt, become dispersed on front 32 and melt. The front carrying the flux proceeds to decompose product portion 16. Thereafter, the aluminum metal cools and solidifies to produce a product casting, which casting is removed from mold 12. The casting is cleaned with a water jet to remove residual refractory coating. Flux excluded to the casting surface is washed away by the water. It is found that the in-mold flux treatment of this invention is effective to reduce the area of oxide folds found in the product casting.

The manner by which the halide salt flux reduces oxide fold defects is not fully understood. The flux may have a de-wetting effect that causes aluminum oxide forming on the front to disperse, thereby preventing formation of a continuous oxide film characteristic of the defect. An effective flux for use in this invention is composed predominantly of alkaline metal chloride compound and contains an aluminum fluoride salt. Suitable aluminum fluoride salts include alkaline metal aluminum fluoride compounds, such as sodium aluminum fluoride (cryolite), or optionally aluminum trifluoride. The mixture is formulated to melt at a temperature less than the aluminum casting temperature and is prefused to produce a more uniform composition and melting temperature. A preferred flux is composed of, by weight, between about 37 and 57 percent potassium chloride (KCl), between about 25 and 45 percent sodium chloride (NaCl), and between about 8 and 20 percent sodium aluminum fluoride ($Na_3AlF_6$). Optionally, aluminum fluoride ($AlF_3$) may be added, preferably in an amount up to about 12 percent and in substitution for a portion of the sodium aluminum fluoride. During casting, it is desired that the melt front carrying the flux advance to the pattern surface and thus form an exterior surface of the casting. The flux may be conveniently removed from the surface by washing with water. However, some flux may become entrapped in the cast metal. Although isolated flux inclusions do not exhibit the deleterious effects of an oxide fold, it is nonetheless desired to minimize the possibility of such inclusions by minimizing the amount of flux. In general, it is believed that, for the preferred flux, an amount between about 0.05 and 0.15 weight percent of the product casting weight is sufficient to reduce significantly oxide fold area.

It is also desirable to locate the flux within the pattern for optimum effectiveness in eliminating oxide fold defects using minimal flux additions. Although in the described embodiment the flux was located in a single pocket in the runner, the flux may be suitably distributed in a plurality of pockets or located in a downsprue or product portion of the pattern. For example, the flux may be located within the product portion adjacent a region having a demonstrated tendency to form an oxide fold defect in the absence of treatment in accordance with this invention. Such location adjacent the particular region may minimize flux inclusions in the remainder of the cast product.

While in the described embodiment flux powder was loaded into a pocket formed in a pattern, the flux may be incorporated into the pattern in any suitable manner for dispersion on the melt front. A pocket may be molded in a pattern section and filled during pattern assembly. Alternately, the flux may be blended into a vaporizable adhesive applied to bond pattern sections during assembly, whereupon the flux is released as the adhesive is vaporized.

While this invention has been described in terms of certain embodiments thereof, it is not intended that it be limited to the above description but rather only to the extent set forth in the claims that follow.

The embodiments of the invention in which an exclusive property or privilege is claimed are defined as follows:

1. In a lost foam process for casting aluminum comprising embedding an expendable pattern formed of a thermally decomposable polymeric material into a refractory mold and casting aluminum melt into said mold to progressively decompose and replace the pattern, said melt forming a front adjacent the decomposing pattern, the improvement comprising incorporating a halide salt flux material within the pattern for dispersion onto said melt front as said front progressively decomposes said pattern, said flux being composed of a halide salt effective to inhibit formation of oxide fold defects in the cast product.

2. In a lost foam process for casting aluminum comprising embedding an expendable pattern formed of a thermally decomposable polymeric material into a refractory mold and casting aluminum melt into said mold to progressively decompose and replace the pattern, said melt forming a front adjacent the decomposing pattern, the improvement comprising providing a body of a particulate halide salt flux material within a compartment formed within said pattern, said body being located along a path of said melt front during casting for dispersion onto said front as said front progressively decomposes said pattern, said flux material being composed predominantly of alkaline metal chloride compound and containing an aluminum fluoride salt selected from the group consisting of alkaline metal aluminum fluoride compound and aluminum fluoride compound, said mixture being formulated to have a melting point less than aluminum casting temperature.

3. In a lost foam process for casting aluminum comprising embedding an expendable pattern formed of a thermally decomposable polymeric material into a refractory mold and casting aluminum melt into said mold to progressively decompose and replace the pattern, said melt forming a front adjacent the decomposing pattern, the improvement comprising providing a body of a powdered halide salt flux material within a compartment formed within said pattern, said body being located along a path of said melt front during casting for dispersion onto said front as said front progressively decomposes said pattern, said flux material being composed of, by weight, between about 37 and 57 percent potassium chloride, between about 25 and 45 percent sodium chloride, between about 8 and 20 percent sodium aluminum fluoride, and optionally up to about 12 weight percent aluminum fluoride, and being effective to inhibit formation of oxide fold defects in the cast product.

* * * * *